US006781051B1

(12) United States Patent
Linossier

(10) Patent No.: US 6,781,051 B1
(45) Date of Patent: Aug. 24, 2004

(54) RADIATING CABLE

(75) Inventor: Thierry Linossier, Montereau (FR)

(73) Assignee: Sagem SA, Paris (FR)

( * ) Notice: Subject to any disclaimer, the term of this patent is extended or adjusted under 35 U.S.C. 154(b) by 0 days.

(21) Appl. No.: 09/937,033

(22) PCT Filed: Mar. 16, 2000

(86) PCT No.: PCT/FR00/00634

§ 371 (c)(1),
(2), (4) Date: Sep. 21, 2001

(87) PCT Pub. No.: WO00/57431

PCT Pub. Date: Sep. 28, 2000

(30) Foreign Application Priority Data

Mar. 23, 1999 (FR) ..... 99 03586

(51) Int. Cl.[7] ..... H01B 7/00; H01B 7/18
(52) U.S. Cl. ..... 174/27; 174/102 R; 174/102 SP
(58) Field of Search ..... 174/27, 28, 36, 174/102 R, 102 SP, 103; 333/1, 12, 22 R; 307/89, 90, 91

(56) References Cited

U.S. PATENT DOCUMENTS 3,906,492 A * 9/1975 Narbaits-Jaureguy et al. 342/28
4,280,225 A * 7/1981 Willis ..... 455/523
4,339,733 A * 7/1982 Smith ..... 333/237
4,370,076 A * 1/1983 Sullivan et al. ..... 405/132
4,404,424 A * 9/1983 King et al. ..... 174/34
4,413,469 A * 11/1983 Paquin ..... 156/178
4,432,193 A * 2/1984 Maki ..... 242/441.2
4,837,405 A * 6/1989 Bonjour et al. ..... 174/36
4,860,343 A * 8/1989 Zetena, Jr. ..... 379/110.01
4,885,747 A * 12/1989 Foglia ..... 370/490
5,010,399 A * 4/1991 Goodman et al. ..... 348/14.01
5,113,159 A * 5/1992 Adriaenssens et al. ..... 333/12
5,247,270 A * 9/1993 Harman et al. ..... 333/237
5,321,372 A * 6/1994 Smith ..... 333/1
5,348,397 A 9/1994 Ferrari
5,381,348 A * 1/1995 Ernst et al. ..... 324/534
5,414,215 A 5/1995 Dunand et al.
5,534,869 A * 7/1996 Harman ..... 342/27
5,663,660 A * 9/1997 Fromion ..... 326/30
6,195,561 B1 * 2/2001 Rose ..... 455/523

FOREIGN PATENT DOCUMENTS

EP 0 469 506 A1 * 7/1991 ..... H04B/5/00
EP 0 840 395 A2 5/1998
GB 1 431 243 A * 4/1976 ..... H01Q/13/20
GB 2 771 859 6/1999

* cited by examiner

*Primary Examiner*—William H. Mayo, III
(74) *Attorney, Agent, or Firm*—Young & Thompson

(57) ABSTRACT

The radiating cable comprises at least one cable segment (1) comprising a pair of insulated conductor wires (2) having first ends (3) connected to a load (4) equal to an impedance characteristic of the insulated conductor wires, and second ends (5) connected to a connector (6).

8 Claims, 1 Drawing Sheet

RADIATING CABLE

The present invention relates to a radiating cable for use in particular in the field of cellular telephony or in local area networks for transmitting data by wireless at up to about 2.4 gigahertz (GHz).

BACKGROUND OF THE INVENTION

The provision of radio coverage in large buildings often requires dedicated equipment to be installed. This coverage is obtained by means of antennas placed inside such buildings.

Technically, it would be advantageous to use radiating cables based in passages, however that gives rise to costs that are often unacceptable. Present-day radiating cables are coaxial cables with slots in periodic patterns and they are expensive, bulky, rigid, and difficult to lay.

Furthermore, when cabling buildings, the high levels of performance provided by present-day radiating cables are unnecessary. The object of the invention is to propose a radiating cable of low cost that is easy to lay, while presenting performance that is sufficient to ensure satisfactory transmission of signals within a building or a vehicle.

OBJECTS AND SUMMARY OF THE INVENTION

The present invention provides a radiating cable comprising a pair of insulated conductor wires, at least one cable segment having first ends connected to a load equal to a characteristic impedance of the cable segment, and second ends connected to a connector. This provides a cable of very great flexibility and compactness which can easily be fixed in the passages of a building by means of the usual techniques for fixing an ordinary telephone cable and which also presents impedance that is independent of length.

In an advantageous version of the invention, the cable has at least two cable segments whose second ends are connected in parallel to the connector. Given the equivalent impedance obtained by connecting the cable segments in parallel, this makes it possible to provide a cable that presents impedance matched to the transceiver to which the radiating cable is connected while making the radiating cable out of cable segments each presenting an impedance that is higher, i.e. generally having better transmission performance than a single cable matching the nominal impedance of the transceiver.

In yet another advantageous aspect of the invention, the two cable segments are identical. This minimizes constraints on storage, and the cable can be installed without any need to identify the cable segments.

Other characteristics and advantages of the invention will appear on reading the following description of a particular non-limiting embodiment of the radiating cable of the invention, given with reference to the accompanying figures, in which:

Figure 1:
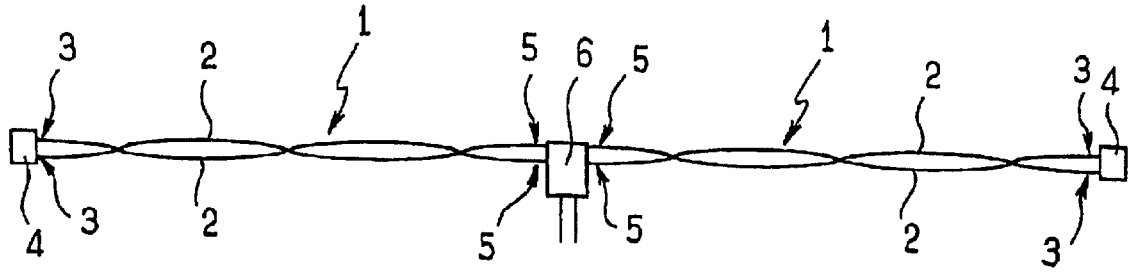
FIG. 1 is a diagram of a radiating cable of the invention comprising two cable segments connected in parallel.

With reference to the figures, the radiating cable constituting the particular embodiment shown comprises two cable segments given overall references 1, each segment comprising a twisted pair of insulated conductor wires 2 having first ends 3 connected to a load 4 and second ends 5 connected in a parallel configuration to a connector 6.

DETAILED DESCRIPTION OF THE INVENTION

In this preferred embodiment, both cable segments 1 are identical and each is made from a pair of solid copper conductors having a diameter of 1.38 millimeters (mm) and covered in insulation having a thickness of 2.2 mm of cellular polystyrene expanded by 41% and covered in a polyethylene skin having a thickness of 0.08 mm. The capacitance of the wire made in this way is 210 picofarads per meter (pF/m) and the insulation has a dielectric constant of 1.463. A cable segment comprising a twisted pair of insulated conductors as described above then has a characteristic impedance of 100 ohms (Ω) so that when the wires are connected to 100 Ω load, the impedance of the cable segments is maintained at 100 Ω, regardless of its length. Two cable segments connected in parallel then have an equivalent impedance of 50 Ω corresponding to the nominal impedance normally required at the input/output (I/O) of a transceiver. The resulting cable is well-balanced, both for transmission and for reception, and when account is taken of its linear attenuation, each cable segment can be up to about 100 meters (m) long for transmission at 450 megahertz (MHz), about 75 m long for 900 MHz, about 45 m long for 1800 MHz, and about 35 m long for 2.4 GHz.

Figure 2:
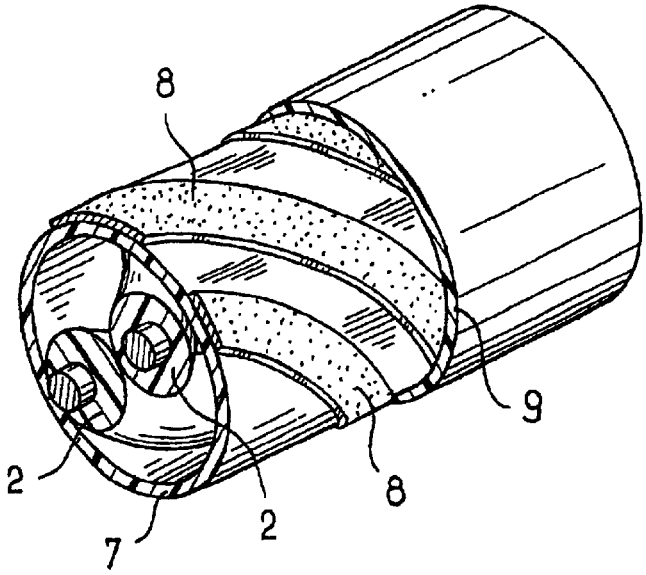
FIG. 2 is a perspective view of a portion of a cable of the invention.

As shown in FIG. 2, the insulated conductors are held together by a dielectric tape 7 made of polyester, polypropylene, or more simply of paper, but preferably made of a material that enables the cable to withstand fire, such as a mineral tape of mica or of glass silk. In this embodiment, the dielectric tape 7 is covered in a series of helically-wound metal tapes 8, having edges that are spaced apart by gaps that are preferably about one or two times the width of the metal tapes so that at high frequency the metal tape contributes to maintaining the characteristic impedance of the radiating cable at a value that is constant, while allowing radiated energy to escape through the gaps between the metal tapes 8. It is also possible to replace the metal tapes 8 by a plurality of metal wires wound around each of the insulated conductor wires.

The cable segment preferably also includes a thin outer sheet 9 of thermoplastic material or of elastomer.

Naturally, the invention is not limited to the particular embodiment described and can be modified without going beyond the ambit of the invention as defined by the claims.

In particular, although the cable of the invention is described in an embodiment comprising identical cable segments connected in parallel, it is possible to provide cable segments that differ either in length or in impedance. Depending on the structure of the zone to be covered, it can be advantageous to use cable segments presenting differing performance, the attenuation in each cable segment being related to the average impedance thereof. For cable segments of different lengths, the cable having the higher impedance preferably covers the longer zone while the cable having the lower impedance covers the shorter zone.

If the geometrical configuration of the premises to be covered is complex, it is also possible to envisage connecting more than two cable segments in parallel, with the characteristic impedance of each cable segment being selected so that the equivalent impedance of the radiating cable corresponds to the nominal impedance of the transceiver used.

In order to increase radiation from the cable, it is possible to provide unbalance between the various elements of the cable, either by using different dimensions or different capacitances per unit length between the various conductor wires by varying the thickness or the nature of the insulating material, or by varying the pitch at which the insulating conductor wires are twisted together, with it being possible for pitch variation to go all the way to reversing the twist direction and/or to keeping the insulated conductor wires parallel to each other over a portion of the cable, with the helical pitch in twisted portions preferably being about 15 to 30 times the diameter of the insulated conductors and with the length of each portion at constant twist being about ten times the helical pitch in question or ten times the adjacent helical pitch for a portion in which the wires are parallel.

When the zone to be covered is very small, e.g. in a building of small dimensions or in a vehicle, it is possible to privilege radiation at the expense of linear attenuation and to provide a cable comprising a parallel pair of wires connected to the load.

The flexibility of the cable can be improved by replacing solid conductors with wires made up of multiple twisted strands.

It is also possible to make the cable of the invention without using metal tapes and/or a dielectric tape.

What is claimed is:

1. An antenna comprising:

two cable segments (1);

each said cable segment comprising a pair of insulated conductor wires (2);

each said cable segment terminating at a first end (3) with a load (4), said cable segment and said load having the same characteristic impedance;

a connector connecting second ends (5) of the two cable segments in parallel; and a transceiver connector connected to said connector, wherein, each of the cable segments have a first length and a total extended length of the two cable segments equals approximately twice the first length.

2. The antenna of claim 1, wherein the two cable segments are identical.

3. The antenna of claim 1, wherein, the insulated conductor wires are twisted copper conductors having a capacitance of 210 picofarads per meter, and insulation of the wires has a dielectric constant of 1.463.

4. The antenna of claim 1, wherein a length of each cable segment is about 35 meters long for transmitting data at up to about 2.4 gigahertz.

5. The antenna of claim 1, further comprising:

a dielectric tape (7) holding together the insulated conductor wires;

metal tapes (10) covering the dielectric tape; and a supporting sheath (9) surrounding the metal tapes, wherein, the metal tapes are wound helically without overlap around the pair of insulated conductor wires, and the metal tapes extend between the dielectric tape and the supporting sheath.

6. The antenna of claim 5, wherein each of the insulated conductor wires comprise multiple twisted wire strands.

7. The antenna of claim 1, wherein, the metal tapes have edges spaced apart by gaps about one to two times a width of the metal tapes.

8. The antenna of claim 1, further comprising:

a dielectric tape (7) holding together the insulated conductor wires;

metal wires (10) wound around each of the insulated conductor wires; and a supporting sheath (9), wherein, the metal tapes are wound helically without overlap around the pair of insulated conductor wires, and the metal tapes extend between the dielectric tape and the supporting sheath.

* * * * *